US005584361A

United States Patent [19]

Cisko et al.

[11] Patent Number: 5,584,361

[45] Date of Patent: Dec. 17, 1996

[54] FORGING DIE LUBRICATOR

[75] Inventors: Lawrence W. Cisko, Harrison City; James R. Anglin, Murrysville, both of Pa.; Aladar Fricke, Cleveland; Phillip J. Pallone, North Royalton, both of Ohio; Frank E. Savor, Espyville; Robert C. Wallace, Lower Burrell, both of Pa.

[73] Assignee: Aluminum Company of America, Pittsburgh, Pa.

[21] Appl. No.: 417,403

[22] Filed: Apr. 5, 1995

[51] Int. Cl.[6] ..... F16N 27/00

[52] U.S. Cl. ..... 184/7.4; 184/6.14; 184/6.26; 72/45

[58] Field of Search ..... 184/6.14, 7.4, 184/8, 9, 27.1, 32, 34, 37, 6.26; 222/318; 137/563; 239/88, 91, 99; 72/43–45

[56] References Cited

U.S. PATENT DOCUMENTS 1,818,314 8/1931 Farmer ..... 184/7.4
2,612,967 10/1952 Leonard ..... 184/7.4
3,756,051 9/1973 Rebsamen et al. ..... 72/45

*Primary Examiner*—Edward K. Look
*Assistant Examiner*—Christopher Verdier
*Attorney, Agent, or Firm*—Elroy Strickland

[57] ABSTRACT

Apparatus for lubricating die and/or workpiece surfaces, the apparatus including a container adapted to capture a predetermined volume of lubricant. At least one nozzle is provided for spraying the volume of lubricant onto the die/workpiece surfaces when the volume is received from the container. A first valve is connected between the nozzle and container, and a reservoir of lubricant and a pump for circulating lubricant through the container and past the first valve at a relatively low pressure is provided, the circulation of lubricant occurring during a portion of a lubricating cycle when no lubricant is sprayed onto the die/workpiece surfaces. A second valve is located between the pump and container for interrupting the flow of lubricant past the first valve, and a blocking valve is located between the container and the reservoir for interrupting the flow of lubricant from the container. A piston is located within the container and an actuator is connected to the piston for moving the same within the container to direct the captured volume of lubricant from the container to the first valve at a pressure sufficient to open the first valve.

15 Claims, 3 Drawing Sheets

FORGING DIE LUBRICATOR

BACKGROUND OF THE INVENTION

The present invention relates generally to lubricating die and workpiece surfaces with "shots" of lubricant on a repetitive basis, and particularly to an apparatus for capturing a predetermined amount of lubricant and delivering the same to forging dies on a consistent, repetitive basis.

Die surfaces of machinery that produces articles of manufacture on a continuing, repetitive basis require proper lubrication in order to minimize tool wear and damage to the fabricated parts. This is particularly true for forging presses where metal forming takes place in the presence of relatively high temperatures. Heretofore, lubricant was supplied to a forging press through a tube or pipe receiving lubricant from a circulating system equipped with a pump and reservoir. Lubricant was directed to die surfaces via a nozzle or other applicator located at one end of the pipe or tube under the pressure supplied by the pump. Such means are not ideally suited for providing precise volumes of lubricant to die surfaces at consistent flow rates, since the delivery of lubricant to the dies alters the flow conditions in the circulating system and, thus, the performance of the pump supplying the lubricant to the die. The resulting changes in flow rates and pressures render volume control difficult and can be further complicated by fluid viscosity changes, as may occur as temperature changes.

BRIEF SUMMARY OF THE INVENTION

The present invention provides a container for holding the correct amount of lubricant and means for repetitive supply of that amount to die and workpiece surfaces upon operation of a piston located within the container. Valves are incorporated that permit circulation of the lubricant through the container during the intervals when charges or "shots" of lubricant are not sent to the die surfaces, and, when required, stop the flow of lubricant through the container to permit capture of a shot amount in the container. The captured shot is directed to the die surfaces by operation of the piston.

The operating volume of the container is adjustable so that the container captures the correct amount of lubricant for supply to the die surfaces. After the amount is supplied, the valves are opened to permit renewed flow of lubricant through the container.

The apparatus of the invention, in addition, provides an inexpensive pressure boost with the ability to handle high viscosity lubricants without excessive heating of the lubricant, and can provide more rapid delivery of the lubricant such that lubricating cycle time is reduced. If spray nozzles are used, the spray pattern is established more rapidly because of the consistent delivery of lubricant to the nozzles.

THE DRAWINGS

Figure 1:
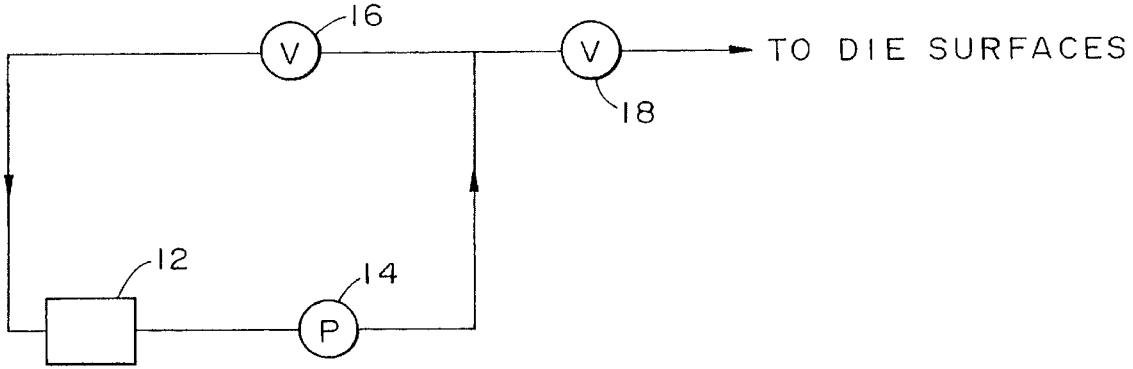
FIG. 1 (PRIOR ART)
Figure 5:
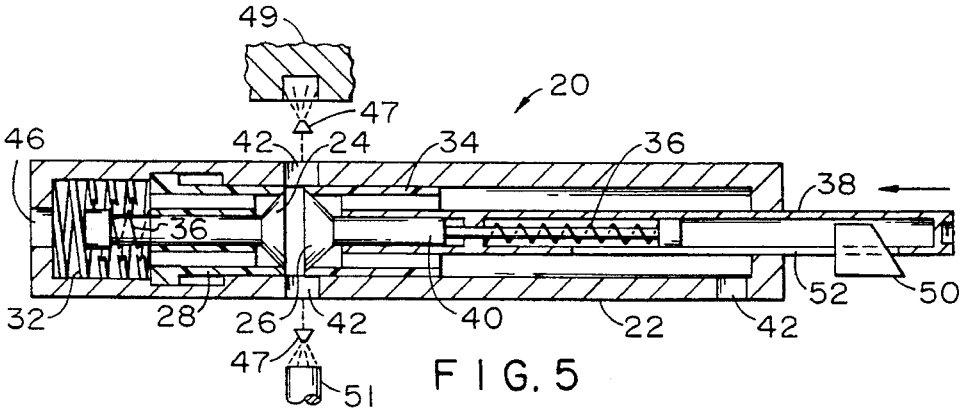
Figure 6:
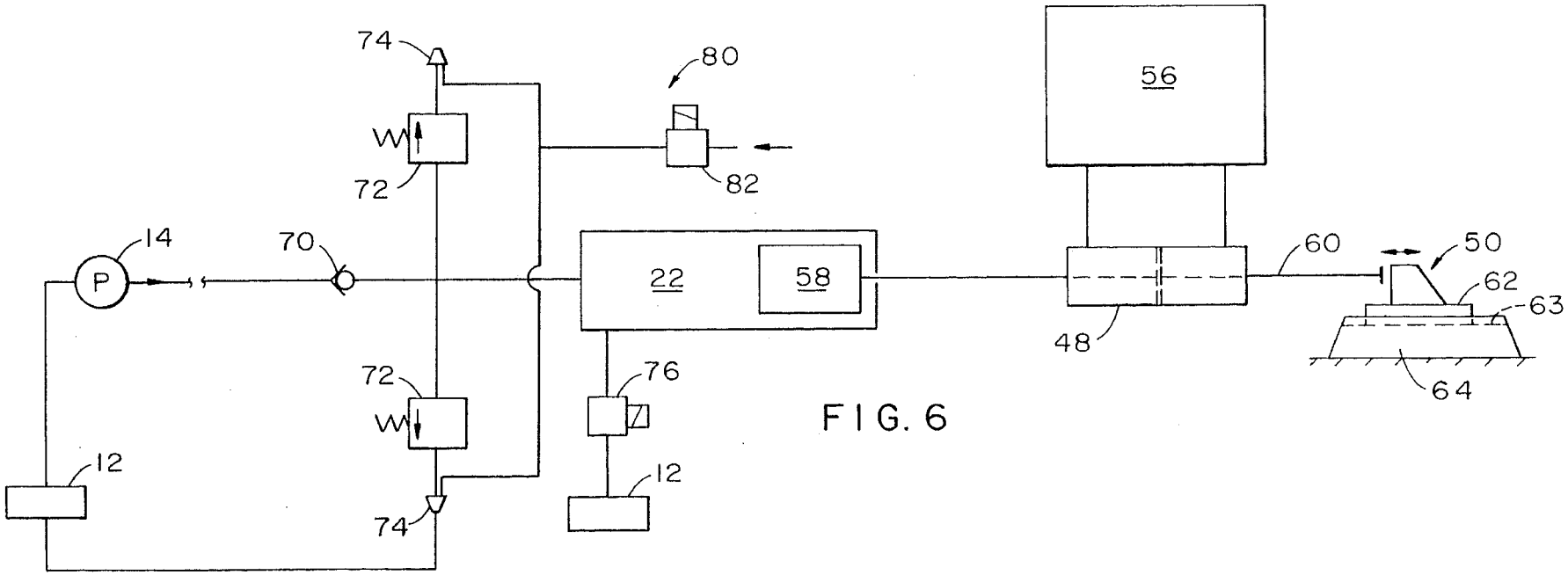
Figure 7:
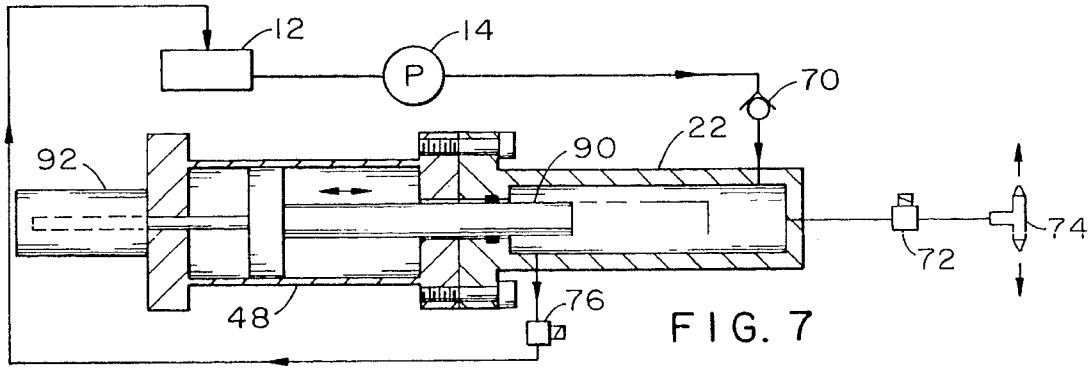

The invention, along with its objectives and advantages, will be better understood from consideration of the following detailed description and the accompanying drawings in which:

FIG. 1 is a schematic representation of a prior system for lubricating forging die surfaces, FIGS. 2 through 5 show one in partial section embodiment of the invention and its operation, FIG. 6 is a schematic view of a second embodiment of the invention, and FIG. 7 is a diagrammatic view in partial section of a third embodiment of the invention.

PREFERRED EMBODIMENTS

Referring now to FIG. 1 of the drawings, a schematic diagram of a prior circulating system is shown for lubricating forging dies. A circulating system is preferred to minimize settling of solid lubricant components suspended in a liquid medium. Lubricant is circulated by a pump 14 from a reservoir 12 (in the direction of arrows in the figure) when valve 16 is open. Another valve 18 is connected between the pump and a set of nozzles (not shown) in FIG. 1. A volume of lubricant is directed to the dies of a forging press when valve 18 is opened and 16 is closed. After the volume is directed to the dies, valve 18 is closed and valve 16 is opened so that circulation of the lubricant resumes.

Valves 16 and 18 are generally operated in a cyclical manner by external controls (not shown). The controls provide shots of lubricant to die surfaces at convenient times in the fabricating cycle of a forging press. The volume of the shot is determined by the delivery rate of the pump and the duration of the shot cycle. The system of FIG. 1 provides no adjustment of the output pressure other than by replacing the pump with one of a smaller or larger size.

In addition, such a system relies on pump pressure, which is not always consistent, to direct the shots of lubricant to the nozzles. In the system of the present invention, the pump provides circulation that allows capture of lubricant in a container but is not used to direct lubricant to the nozzles, hence controlling the amount of lubricant delivered to the nozzles.

FIGS. 2 through 5 of the drawings show the operation of a system 20 of the invention for lubricating forging dies. System 20 is an embodiment of the invention in which a container 22 and two valves 24 and 26 located in the container are operated to capture a volume of lubricant and then direct the same to the surfaces of the dies. The captured volume is a charge or shot of lubricant that is directed to dies during a portion of a forging cycle. Between the occurrence of shots, lubricant is circulated through the container.

Valve 24 extends through the center of a hollow "blocking" piston 28 in container 22, and is maintained in an open position by the hydraulic force of the circulating lubricant working against the closure force of a spring 30. A second spring 32 forces piston 28 forwardly in the container to block ports or openings 42 provided in the wall of container 22.

Opposite valve 24 is valve 26 and a second hollow piston 34. Valve 26 is held in an open position by a stop 50 located behind piston 34 and penetrating into a hollow shaft 38 connected to the piston. A spring 36 is located within hollow shaft 38 and between the rearward end of a stem 40 of valve 26 and stop 50. Spring 36 causes valve 26 to close as piston 34 advances towards 26. Valve stem 40 extends into the hollow shaft 38 and has a diameter that allows the shaft to travel freely thereover.

Figure 2:
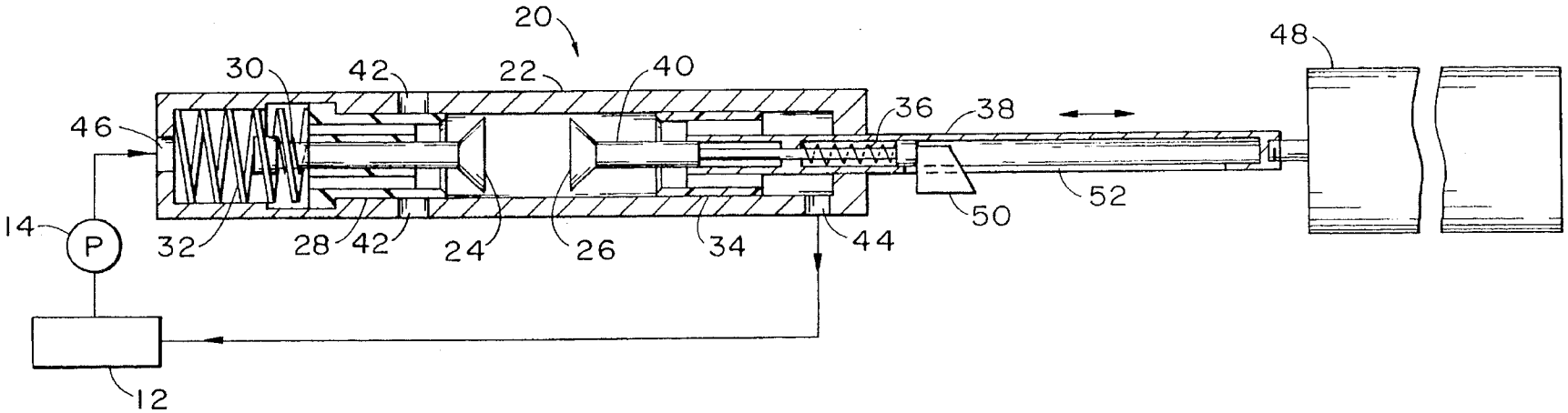
Figure 3:
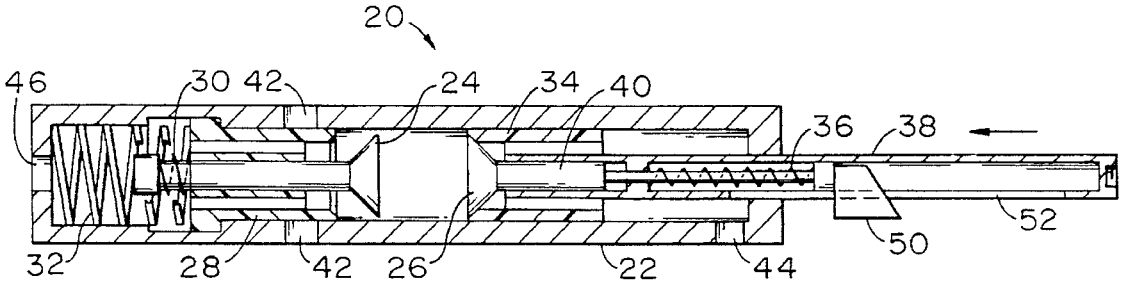
Figure 4:
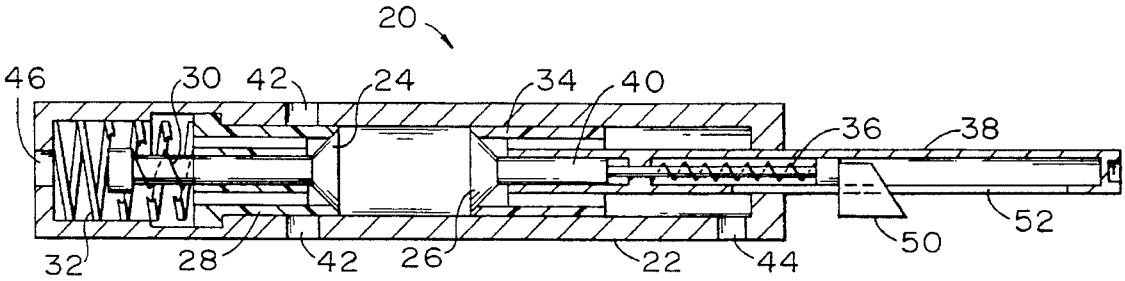

Two ports or openings 42 are shown in FIGS. 2 to 5 in the wall of container 22 at a location behind valve 24, and a third port 44 is provided in the container wall behind piston 34. A fourth port 46 is provided in the wall of the container behind valve 24 and spring 32. Ports 42 lead to nozzles 47 in FIG 5 of the drawings for spraying lubricant onto die surfaces 49 and 51 . In FIG. 2 piston 28 is in a position that closes and blocks ports 42.

FIG. 2 shows the system in a stand-by mode; an actuator, such as a cylinder 48, is fully retracted and lubricant is circulated through container 22. With the cylinder fully retracted, piston 34 is in its rear-most position and valve 26 is held open against the closure force of spring 36 by the force of cylinder 48 holding valve stem 40 against valve stop 50. Lubricant enters through port 46 and flows through piston 28 and around unseated valve 24. Valve 24 is unseated by the hydraulic force of the circulating fluid working against the force of spring 30. The lubricant flows around valve 26, through piston 34 and out exit port 44. Since piston 28 is blocking nozzle ports 42, lubricant is prevented from exiting through these ports.

Piston 28 is held in place by spring 32.

When a lubrication cycle is initiated, cylinder 48 is actuated, thereby advancing piston 34 via shaft 38 towards valve 26. As piston 34 advances, spring 36 works against valve 26 and piston 34 in such a way as to hold the valve closed when the position of the piston is in a forward location sufficient to allow valve stem 40 to leave stop 50. This works to close valve 26. Closure is completed when piston 34 advances to the point where valve stem 40 is no longer in contact with stop 50. This instant of closure is captured in FIG. 3. Actuating cylinder 48 is omitted from FIGS. 3 through 5, as are reservoir 12 and pump 14.

As soon as valve 26 closes, lubricant flow through container 22 is stopped. With no lubricant flow, there is no pressure difference across and no hydraulic force against valve 24. Valve 24 thus closes against piston 28 under the action of spring 30. The relationship of the components of system 20 at this instant is captured in FIG. 4. The closed valves 24 and 26 now capture a volume of lubricant between them, which is the discharge volume of the system, minus a small amount of lubricant since mechanical closure is not always absolute.

Piston 34 and valve 26 continue to advance under the force of cylinder 48. The captured lubricant works against the face of closed valve 24 and piston 28, moving the valve and piston against the action of spring 32, which uncovers nozzle ports 42. Continued advancement of piston 34 and valve 26 forces discharge of the volume between valves 24 and 26, minus again the small amount of lubricant escaping by the mechanical closure, through nozzle ports 42 and onto punch and die surfaces.

FIG. 5 shows the relationship between the system components as the discharge cycle ends.

While the above operation is occurring, the circulating pump is still operating and pump discharge pressure is acting on port 46. This pressure, however, is low enough to have no effect on the discharge cycle of the system.

Upon conclusion of the discharge cycle, piston 34 is retracted by cylinder 48. As the piston retracts, a pressure gradient develops across piston 28 which, with the help of its spring 32 returns piston 28 across nozzle ports 42 to close them. The action of the pressure gradient then unseats valve 24 against the force of spring 30, and allows lubricant to enter container 22 through inlet port 46, as piston 34 continues its rearward travel. When piston 34 retracts to the point where the valve stem 40 contacts stop 50, valve 26 is unseated from piston 34 against the pressure of spring 36, and continuity between inlet port 46 and outlet port 44 is reestablished. Consequently, the pressure gradient developed by the circulating pump causes the resumption of lubricant flow such that the system is back to the state described in connection with FIG. 2.

The movements of piston 34 and cylinder 48 are the same in this embodiment and cannot themselves be adjusted. The position of stop 50, however, locates the position of valve stem 40 in container 22 and thus controls the discharge volume. The stop extends into hollow tube 38 through a slot 52 provided in the wall of the tube. By moving the stop lengthwise along the slot, the amount of lubricant captured is changed since the stop locates the position of valve stem 40 and valve 26. The stop can be slidably moved and fixed in a member 64 (FIG. 6), which can be provided with thumb screws, for example, to permit manual fixing of the stop in the fixed member after the stop is adjusted.

Cylinder 48 can be operated automatically and in a repetitive manner by a computer or a programmable electrical controller (not shown). In addition, the cylinder can be a commercially available hydraulic type having a power supply 56 (FIG. 6) that orders and interrupts hydraulic pressure to the cylinder on command from the computer or controller.

FIG. 6 of the drawings shows another embodiment of the invention. The components in FIG. 6 that are the same as those in FIGS. 1 to 5 are designated by the same reference numerals.

In FIG. 6, a cylinder 48 moves a piston 58 located in a container 22 in the manner of the embodiment shown in FIGS. 2 to 5, and adjustability of the volume of lubricant captured by the container is provided by an adjustable stop mechanism 50 located behind cylinder 48. The cylinder is "double ended" such that a shaft or stem 60 extends between the piston (not visible) within the cylinder and the stop mechanism 50. The stop mechanism can include a base 62 contained and slidable in a longitudinal groove 63 provided in a fixed member 64. When adjustment is made, base 62 can be fixed in member 64 by set screws or other suitable means for fixing the base in the member.

In the FIG. 6 embodiment, the valves that control the flow of lubricant to and from container 22 are located externally of the container. More particularly, a check valve 70 is serially connected between a pump 14 and container 22, and pressure relief (or check) valves 72 are connected in parallel between check valve 70 and the container in a manner that can direct lubricant to nozzles 74 for spraying on die surfaces.

Similarly, a blocking valve 76 is connected to container 22 at a location in front of piston 58, and between a reservoir 12 of lubricant and the container.

If valves 72 are check valves, as opposed to pressure relief valves, the valves have a "cracking pressure" above the pressure at which lubricant is circulated through the system by pump 14. For example, circulating pressure can be on the order of 75 psi, while the cracking pressure for check valves 72 can be in the range of 90 to 120 psi.

The circulating pressure of the lubricant in all embodiments of the invention must be sufficient to provide a flow rate that fills container 22 with lubricant in the period of time between discharge of each lubricant shot to the nozzles and die surfaces.

The operation of the embodiment of FIG. 6 is similar to that described above in connection with FIGS. 2 to 5. In FIG. 6, lubricant is circulated through the system when check valve 70 is open, valves 72 are closed, and valve 76 is open. When it is time to direct a shot of lubricant to die surfaces, valve 76 is closed and the piston 58 is advanced by cylinder 48, which forces check valve 70 to close. When the pressure in the portion of the system between check valve 70 and piston 58 reaches the relief or cracking pressure of valves 72, the valves open to direct the lubricant to nozzles 74 and thus to die surfaces.

After the shot is directed to the die surfaces, the piston is retracted to the rear of container 22 by cylinder 48, refilling the container as it retracts. The pressure within the container and to valves 72 falls such that lubricant can now pass through valve 70 to the container from pump 14. Blocking valve 76 is also now opened so that lubricant flowing to the container can leave the container for return to reservoir 12.

Blocking valve 76 can be controlled by the operation of cylinder 48, and can be effected through a computer or a programmable controller (not shown).

If atomization of the lubricant directed to the die surfaces is desired or required, nozzles 74 can be selected for atomizing use with or without air assistance. If air assistance is needed, a system such as 80 in FIG. 6, can be used. In system 80, air can be supplied to an electrically operative valve 82 which controls the supply of air to nozzles 74. Valve 82 can be operated in conjunction with the operation of cylinder 48, i.e., the valve can be mechanically tied to the stroke of the cylinder piston (not shown) or electrically tied thereto such that when the cylinder is signaled to thrust piston 58 forwardly, valve 82 is opened to supply air to nozzles 74. In this manner, when the charge of lubricant reaches nozzles 74, pressurized air is available to spray the charge over the area of the die surfaces.

FIG. 7 of the drawings shows an embodiment of the invention in which the piston 58 of the FIG. 6 embodiment is replaced by a rod 90 extending directly from a cylinder 48 into container 22, cylinder 48 being attached to the rear of the container. (The components in FIG. 7 that are the same or similar to those of the earlier figures bear like reference numerals.) In addition, the stop components 50 of the earlier embodiments are replaced by a transducer 92 attached to the rear of the cylinder. The transducer and associated electronics packaged with it, senses directly the position of rod 90 and orders cylinder operation in response to rod position on a repetitive basis, as described above in connection with the earlier embodiments, i.e., when the transducer is set to operate the cylinder, rod 90 is thrust into container 22, as shown in phantom in FIG. 7, to displace the lubricant contained therein to valve 72 and to nozzles 74. Blocking valve 76 is closed electrically in cooperation with the operation of transducer 92, and valve 70 closes under pressure of advancing rod 90.

Rod 90 is withdrawn toward the rear of container 22, on orders from transducer 92, thereby reducing pressure in the container. Valve 76 is opened in cooperation with the transducer, and valve 70 opens under the reduced pressure in the container so that lubricant flows to fill the container from reservoir 12 for the next delivery of lubricant to nozzles 74.

Transducer 92, cylinder 48 and the electronics are packaged together in an integral manner, and are commercially available, for example, from Vickers Actuator Products, 2425 West Michigan Avenue, Jackson, Mich.

What is claimed is:

1. Apparatus for lubricating die and/or workpiece surfaces, comprising:

a container adapted to capture a predetermined volume of lubricant, at least one nozzle for spraying said volume of lubricant onto the die and/or workpiece surfaces when said volume is received from the container, a first valve connected between the nozzle and container, a reservoir of lubricant for supplying the lubricant to the container, a pump for circulating said lubricant through the container and past the first valve at a relatively low pressure during a portion of a lubricating cycle when no lubricant is sprayed on the die surface, a check valve located between the pump and the container for interrupting the flow of lubricant past the first valve, a blocking valve located between the container and the reservoir for interrupting the flow of lubricant from the container, a piston located within the container, and an actuator connected to said piston for moving the same within the container to direct the captured volume of lubricant from the container to the first valve at a pressure sufficient to open said valve.

2. The apparatus of claim 1 in which the first valve is a pressure relief valve.

3. The apparatus of claim 1 in which the first valve is a check valve having a cracking pressure that is higher than the circulating pressure of the lubricant supplied from the reservoir.

4. The apparatus of claim 1 in which an adjustable stop is provided to change the position of the piston within the container while lubricant from the reservoir is circulated and thus the predetermined volume of lubricant captured in the container.

5. The apparatus of claim 4 in which the cylinder is double ended and the adjustable stop is located outside of the cylinder and at an end thereof remote from the container.

6. The apparatus of claim 1 including means for supplying pressurized air to the nozzle to provide an atomized lubricant spray to the die and/or workpiece surfaces from the nozzle, said means including a source of pressurized air and an air valve located between said source and the nozzle.

7. The apparatus of claim 6 in which the air valve is opened when the cylinder directs the lubricant from the container to the first valve.

8. The apparatus of claim 6 in which the air and blocking valves are electrically operated in respectively controlling the supply of air to the nozzle and the flow of lubricant from the container.

9. The apparatus of claim 6 in which operations of the cylinder and the air and blocking valves are accomplished by a programmable electrical controller.

10. The apparatus of claim 1 in which the die and/or workpiece surfaces include multiple surfaces, and a plurality of nozzles are connected to receive the captured volume of lubricant from the container and spray the same on such surfaces.

11. The apparatus of claim 1 in which the lubricant in the reservoir is a liquid containing solids, and the pump directs said lubricant through the container when the first valve is closed at a rate sufficient to maintain suspension of the solids in the liquid.

12. Apparatus for lubricating die and/or workpiece surfaces, comprising:

a container adapted to capture a predetermined volume of lubricant, at least one nozzle for spraying said volume of lubricant to said surfaces as said volume is received from the container, a first valve located between the nozzle and container, a reservoir of lubricant and a pump for circulating the lubricant through the container and past said valve during a portion of a lubricating cycle when no lubricant is directed through said valve and nozzle, a second valve located between the pump and container for interrupting the flow of lubricant from the pump, and an actuator for moving the predetermined volume of lubricant within the container from the container to said first valve at a pressure sufficient to transfer said volume to the nozzle.

13. Apparatus for lubricating die and/or workpiece surfaces, comprising:

a container adapted to capture a predetermined volume of lubricant, a cylinder connected to said container, and a rod extending into the container from said cylinder, at least one nozzle for spraying the volume of lubricant in said container on a die surface when the lubricant is received from the container, a first valve connected between the nozzle and container, a reservoir of lubricant and a pump for circulating the lubricant through the container and past the first valve at a relatively low pressure during a portion of a lubricating cycle when no lubricant is sprayed on the die surface, a check valve located between the pump and container for interrupting the flow of lubricant past the first valve, and a blocking valve located between the container and the reservoir for interrupting the flow of lubricant from the container, said cylinder being effective to move the rod within the container to direct the captured volume of lubricant from the container to the first valve at a pressure sufficient to open said valve.

14. The apparatus of claim 15 in which a transducer is connected to the cylinder for sensing the position of the rod and for controlling the cylinder in response to rod position.

15. In a continuous system of circulating lubricant until the circulation is interrupted for accumulating a predetermined volume of lubricant, the system including:

a container for capturing a predetermined volume of lubricant, a first valve located to release said volume from the container, at least one nozzle connected in fluid communication with said first valve, a piston located within the container, an actuator connected to said piston for moving the same within the container to direct the captured volume of lubricant to said first valve, a reservoir of lubricant for supplying lubricant to the container, a pump circulating the lubricant through the first valve and through the container at a relatively low pressure when no lubricant is sprayed on the die surface, and a second valve for interrupting the flow of lubricant through the container to begin accumulation of the predetermined volume of lubricant.

* * * * *

UNITED STATES PATENT AND TRADEMARK OFFICE

CERTIFICATE OF CORRECTION

PATENT NO. : 5,584,361

DATED : December 17, 1996

INVENTOR(S) : Lawrence W. Cisko et al.

It is certified that error appears in the above-indentified patent and that said Letters Patent is hereby corrected as shown below:

| | |
|---|---|
| Col. 8, claim 14, line 1 | Should depend on claim 13 |
| Col. 8, claim 15, line 14 | Insert after "valve" --for spraying the captured volume on a die surface |

Signed and Sealed this

Fourth Day of March, 1997

Bruce Lehman

*Attest:*

BRUCE LEHMAN

*Attesting Officer*

*Commissioner of Patents and Trademarks*